US011021346B2

(12) United States Patent
Babinchak et al.

(10) Patent No.: US 11,021,346 B2
(45) Date of Patent: Jun. 1, 2021

(54) WOVEN WEBBING COMBINING EDGE AND BODY WEAVE DESIGN FEATURES FOR IMPROVED OVERALL DURABILITY IN LIFTING AND RESTRAINT APPLICATIONS

(71) Applicants: Lift-All Company, Inc., Landisville, PA (US); E. Oppermann GmbH, Einbeck (DE)

(72) Inventors: Gregory S. Babinchak, Elizabethtown, PA (US); Steven Pacilio, Landisville, PA (US); Andreas Oppermann, Einbeck (DE); Falk Oppermann, Einbeck (DE)

(73) Assignee: Lift-All Company, Inc., Landisville, PA (US)

( * ) Notice: Subject to any disclaimer, the term of this patent is extended or adjusted under 35 U.S.C. 154(b) by 51 days.

(21) Appl. No.: 16/373,024

(22) Filed: Apr. 2, 2019

(65) Prior Publication Data

US 2020/0318262 A1 Oct. 8, 2020

(51) Int. Cl.

| | |
|---|---|
| ***B66C 1/12*** | (2006.01) |
| ***D03D 11/02*** | (2006.01) |
| ***D03D 1/00*** | (2006.01) |

(52) U.S. Cl.

CPC ..... *B66C 1/12* (2013.01); *D03D 1/0041* (2013.01); *D03D 11/02* (2013.01)

(58) Field of Classification Search

CPC ... B66C 1/12; B66C 1/122; B66C 1/18; B60P 7/0869; D03D 1/0041; D03D 1/0005; D03D 11/02

USPC ..... 294/74

See application file for complete search history.

(56) References Cited

U.S. PATENT DOCUMENTS

| | | | | |
|---|---|---|---|---|
| 4,174,738 | A | 11/1979 | Berger et al. | |
| 4,600,626 | A * | 7/1986 | Ogata | B60R 22/12 139/384 R |
| 4,856,837 | A | 8/1989 | Hammersla, Jr. | |
| 5,436,044 | A | 7/1995 | Pinkos | |
| 5,727,833 | A * | 3/1998 | Coe | B66C 1/12 294/74 |
| 6,283,167 | B1 | 9/2001 | Chang et al. | |
| 7,721,518 | B2 * | 5/2010 | Danzey | D03D 5/00 57/210 |
| 8,434,527 | B2 | 5/2013 | Welz et al. | |
| 9,408,450 | B2 * | 8/2016 | Schlipper | A45C 13/30 |

(Continued)

*Primary Examiner* — Dean J Kramer

(74) *Attorney, Agent, or Firm* — Saxton & Stump, LLC

(57) ABSTRACT

A woven webbing for use in a tiedown or sling for lifting, restraint or other material handling functions. The woven webbing includes a central portion and tubular edges. The central portion has a top surface and an oppositely facing bottom surface. The top surface and bottom surface may be woven in a first pattern for strength and abrasion resistance while remaining flexible. The tubular edges extend from either side of the central portion. The tubular edges may be woven in a second pattern to improve the cut resistance of the tubular edges. The tubular edges have interior cavities which may include twisted floating yarn extending therethrough to enhance the cut resistance of the tubular edges. The tubular edges may include a high modulus yarn material which changes the orientation of the yarn material away from the axial direction of tension when a load is applied to the webbing.

15 Claims, 3 Drawing Sheets

(56) References Cited

U.S. PATENT DOCUMENTS

| | | | | |
|---|---|---|---|---|
| 2014/0113519 | A1* | 4/2014 | Golz | D02G 3/442<br>442/190 |
| 2016/0046465 | A1* | 2/2016 | Babinchak | B60P 7/0869<br>294/74 |

* cited by examiner

WOVEN WEBBING COMBINING EDGE AND BODY WEAVE DESIGN FEATURES FOR IMPROVED OVERALL DURABILITY IN LIFTING AND RESTRAINT APPLICATIONS

FIELD OF THE INVENTION

The present invention is directed a tiedown or sling for lifting, restraint or other material handling functions with improved durability. In particular, the invention is directed to a woven webbing for use in a tiedown or sling having a flexible webbing that combines a woven twill central portion with a pliable edge of tubular construction to improve the cut resistance of the edges.

BACKGROUND OF THE INVENTION

Woven webbings have long been used as straps and/or slings for securing, lashing or lifting various objects. When such straps or slings are used in various environments, the edges of the straps or slings often come into contact with sharp objects which can abrade and/or cut the edges, causing the strap to cut, tear or break. In order to make the edges more cut resistant, it is known in the art to strengthen the edges relative to the central region by weaving coated, multifilament or bulked yarns along the edges. However, such coated, multifilament or bulked yarns increase the cost of manufacturing the strap or sling. In addition, the weaving vinyl-coated yarns along the edges also has the drawback of stiffening the edges of the strap or sling relative to the central region, thereby making the strap or sling less desirable to handle once damaged.

It would, therefore, be beneficial to provide a tiedown or sling for lifting, restraint or other material handling functions having a flexible webbing with a soft edge that combines a woven twill central portion with a pliable tubular edge to improve the cut resistance of the edges.

SUMMARY OF THE INVENTION

An object of the invention is to provide a woven product, such as, but not limited to, a tiedown or sling for lifting, restraint or other material handling functions which has improved abrasion and edge cutting resistance.

An embodiment is directed to a woven webbing for use in a tiedown or sling for lifting, restraint or other material handling functions. The woven webbing includes a central portion and tubular edges. The central portion has a top surface and an oppositely facing bottom surface. The top surface and bottom surface are woven in a first pattern for strength and abrasion resistance while remaining flexible. The tubular edges extend from either side of the central portion. The tubular edges with a woven second pattern improve the cut resistance of the edges.

An embodiment is directed to a woven webbing for use in a tiedown or sling for lifting, restraint or other material handling functions. The woven webbing has a central portion. The central portion has a top surface and an oppositely facing bottom surface. The top surface and bottom surface are woven for strength and abrasion resistance while remaining flexible. The woven webbing has tubular edges which extend from either side of the central portion. The tubular edges are woven to improve the cut resistance of the tubular edges. The tubular edges have interior cavities with twisted floating yarn extending therethrough to enhance the cut resistance of the tubular edges.

An embodiment is directed to a woven webbing for use in a tiedown or sling for lifting, restraint or other material handling functions. The woven webbing includes a central portion which has a top surface and an oppositely facing bottom surface. The central portion is woven for strength and abrasion resistance while remaining flexible. Tubular edges extend from either side of the central portion, the tubular edges are woven to improve the cut resistance of the tubular edges. The tubular edges include a high modulus yarn material which changes the orientation of the yarn material away from the axial direction of tension when a load is applied to the webbing, wherein the high modulus yarn material reduces the tension in the tubular edges while the webbing is in a loaded condition, thereby improving the durability and cut resistance of the tubular edges.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
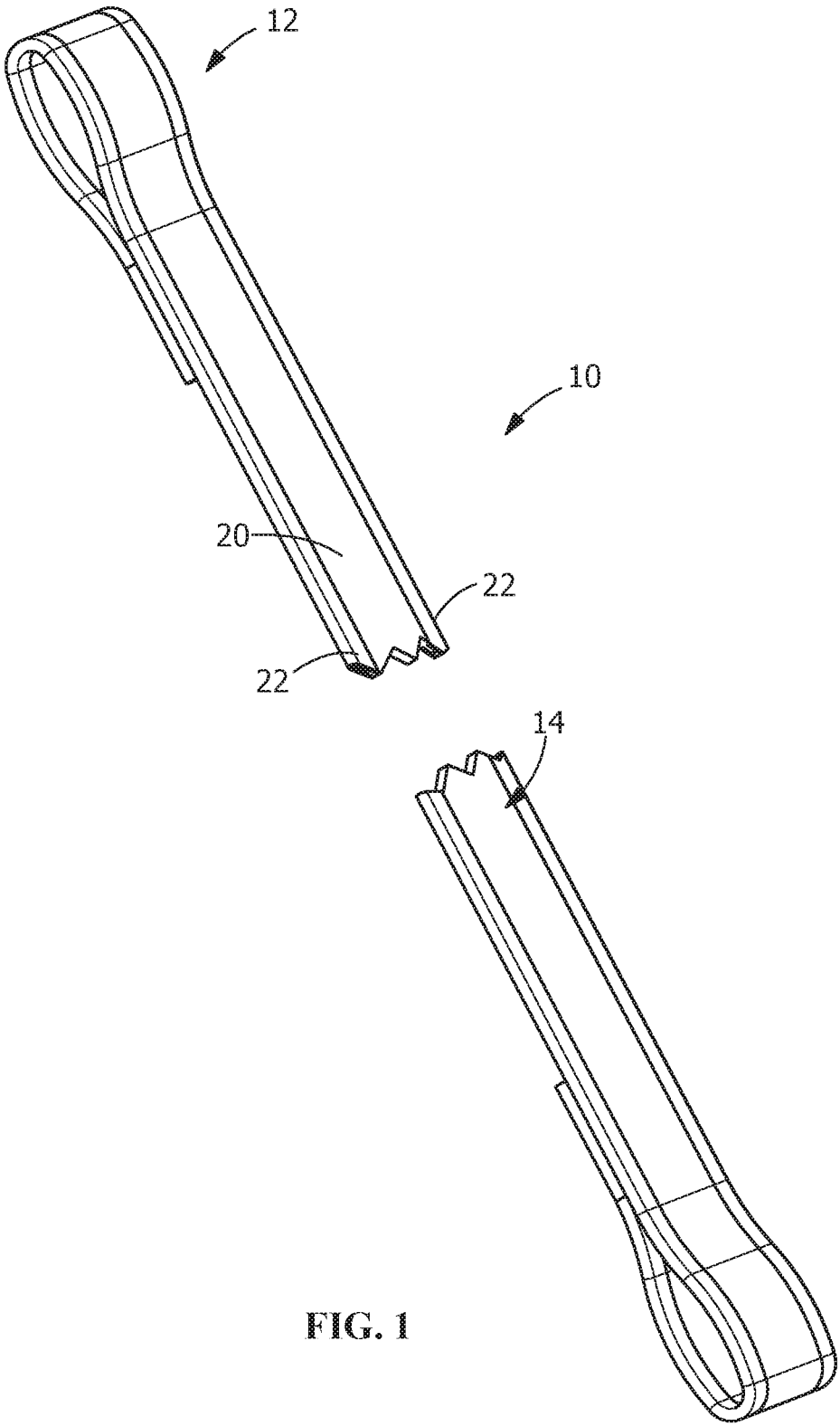
FIG. 1 is a perspective view of an illustrative embodiment of a sling of the present invention, the sling having cut resistant edge portions.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, an illustrative tiedown or sling 10 for lifting, restraint or other material handling functions includes soft eyes 12 at either end. While the eyes 12 are shown at either end, other embodiments of the strap or sling 10 may be used without departing from the scope of the invention. The strap or sling 10 may be used to lift or lash an object or may be used as a component of a device which used for lifting or lashing.

Figure 2:
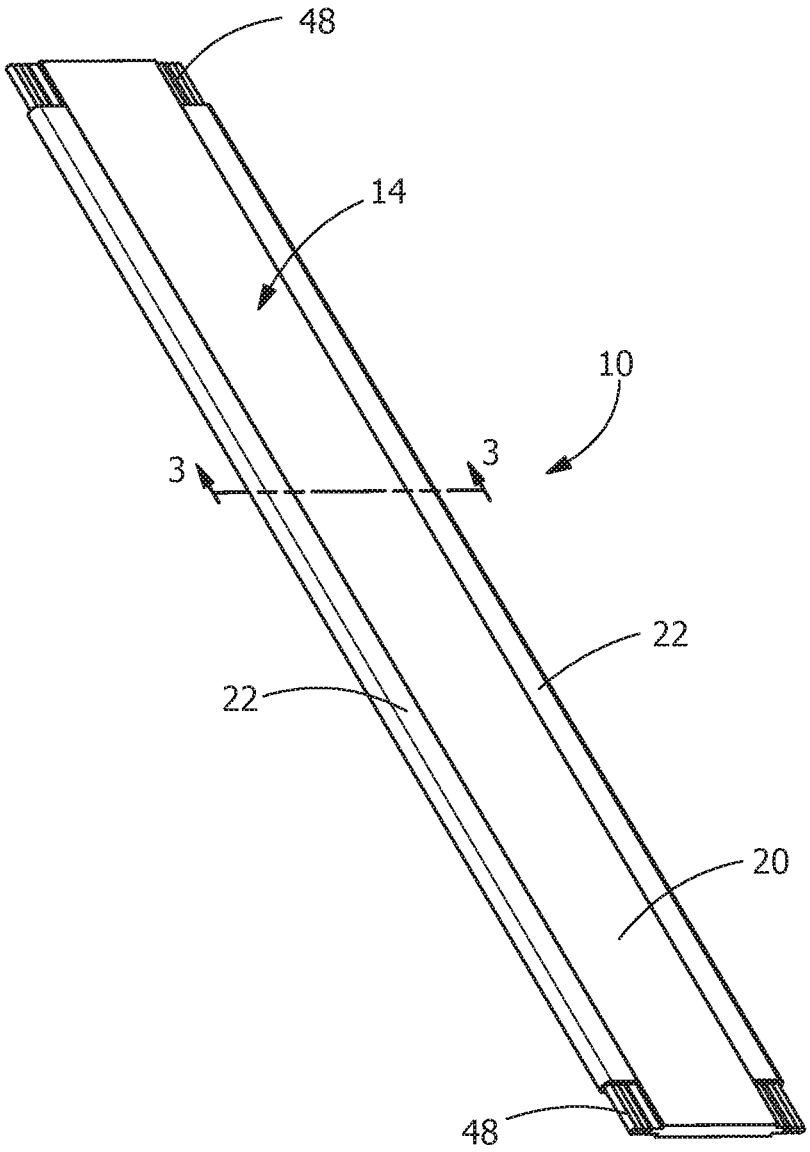
FIG. 2 is an enlarged perspective view of a portion of the sling of FIG. 1.
Figure 3:
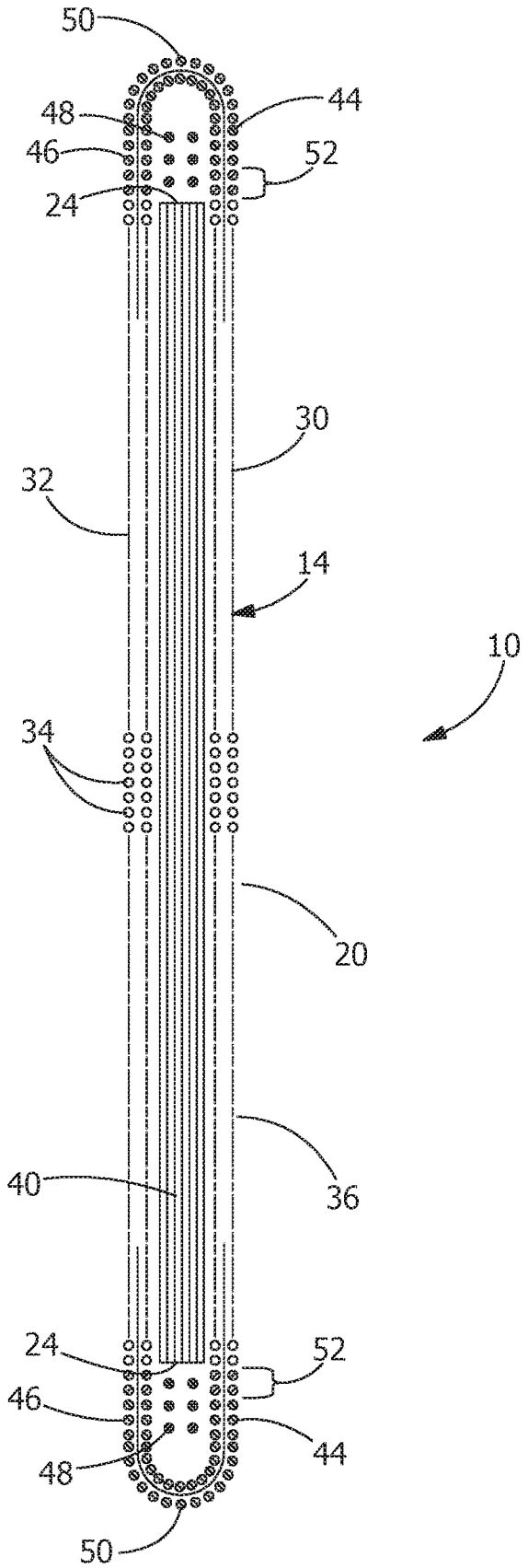
FIG. 3 is a cross-sectional view of the of the sling taken along line 3-3 of FIG. 2.

As best shown in FIGS. 2 and 3, the strap or sling 10 is made of webbing 14 which has a central portion 20 and cut resistant tubular, hollow edges or selvage portions 22. The tubular edges 22 extend continuously along opposing edges 24 of the central portion 20. The tubular edges 22 afford protection of the central portion 20 against abrading or cutting at any point along the opposing edges 24 of the central portion 20. While the illustrative embodiment shows the webbing 14 used for a tiedown or sling for lifting, restraint or other material handling functions, the webbing may be used for other material handling functions.

The central portion 20 has an upper ply 30 and a lower ply 32. The upper and lower plies 30, 32 are formed of warp yarns 34 continuously woven with weft yarns 36. In the illustrative embodiment shown, the upper ply 30 and lower ply 32 are woven in a twill weave pattern for strength and abrasion resistance while remaining flexible, however, other types of weave may be used. The upper and lower plies 30, 32 are bound together along the central portion 20 by binder yarns in a conventional manner. Stuffer yarns 40 are sandwiched between the upper and lower plies 30, 32 and are bound in place in the central portion 20 by the binder yarns.

The cut resistant tubular, hollow edges or selvage portions 22 extend from either edge 24 of the central portion 20. The cut resistant tubular edges 22 extend from the upper ply 30 to the lower ply 32. The cut resistant tubular edges 22 are attached to the upper and lower plies 30, 32. However, the upper portion 44 and the lower portion 46 of the tubular edges 22 are not bound together. The webbing of the cut resistant tubular edges 22 is woven from plied and twisted polyester yarn which is enhanced with interior twisted floating yarns. However, other types of fibers may be used without departing from the scope of the invention.

Supplemental or floating stuffer yarn 48 may also be provided in the hollow portion of the cut resistant tubular edges 22. However, the stuffer yarn 48 is not required or used in all embodiments.

The yarns used for the cut resistant tubular edges 22 in the illustrative embodiment include a first yarn 50 and a second yarn 52. The improved edge cut resistance is created by the tubular edge woven from plied and twisted polyester yarn which is enhanced with interior twisted floating yarns. The first yarn, second yarn and stuffer yarn give the cut resistant tubular edges 22 three areas of protection: outside tubular yarn, inside floating yarns and transition yarns. The cut resistant tubular edges 22 can be loom state, natural heat set or dyed any color with abrasion resistant coating.

The first yarn 50 is a polyester yarn which has 3 strands of 1,000/1 urethane coated polyester which are twisted into 1 strand of yarn with 1.2 turns per inch of "S" twist. The second yarn 52 is a polyester yarn which has 3 strands of 1,000/1 polyester which are twisted into 1 strand of yarn with 1.2 turns per inch of "S" twist. However, other yarns, coatings and twist variations may be used. In the illustrative embodiment, the first yarn 50 of the tubular edges 22 are in a first or plain weave pattern.

The floating stuffer yarn 48 is 1 strand of 1,000/1 natural polyester twisted with 8 turns per inch of "Z" twist. Two strands are plied together with 6 turns per inch of "S" twist to combine into 1 strand. However, other yarns may be used. The floating stuffer yarn is woven in a second pattern which is different than the first pattern of the first yarn 50.

The second yarn 52 provides a transition between the first yarn 50 and the yarns of the central portion 20. The second yarn is woven in a third pattern which is different than the first pattern of the first yarn 50 and the second pattern of the floating stuffer yarn 48.

The core reinforcement yarns consists of multiple ends of yarn that achieves an elevated resistance to damage from abrasion and cutting through a combination of elevated twist of component yarn and also an elevated twist rate applied when the yarn ends are joined together. An "elevated twist" is a twist rate of 3 or more twists per inch is applied to the material.

In other illustrative embodiments, in order to improve the durability and cut resistance of yarn that is positioned along the webbing selvage portions 22, the yarn 50 woven along the edge can incorporate fibers that have been modified in a manner than minimizes the tension in this material while the webbing is in a loaded condition. This yarn, which may be of high modulus form of material, may be modified in a manner that changes the orientation of yarn material away from the axial direction of tension when it is applied to the webbing. Examples of yarn modifications used for this purpose may include: 1) Using a bulked to texturized yarn, 2) using yarn that is heavily twisted or spirally wound around a more flexible or lower modulus material, 3) using braided yarn or yarn that is braided about a more flexible or lower modulus material, or 4) a combination of any of these. By using one or more of these modified forms of yarn, yarn materials having a higher modulus than the materials used in the webbing body may be used for improved durability and cut resistance along the edge of the webbing.

In still other illustrative embodiments, in order to improve the durability and cut resistance of yarn that is positioned along the webbing selvage portions 22, strands of the yarn 50 positioned along the edge of webbing selvage portions 22 which is spaced the greatest distance from the edge 24 of the central portion 20 may have different strength characteristics that the remaining first yarn of the webbing selvage portions 22. For example, several strands of the first yarn 50 may be coated to increase the stiffness of the yarns.

The use of the cut resistant tubular, hollow edges or selvage portions 22 provides a flexible webbing 14 with a soft edge that combines a central portion with a soft edge to improve the cut resistance of the edges. This allows the sling 10 to remain flexible and safe for handling by a user, while providing additional damage protection to the outside edges of the sling 10. The webbing 14 may be woven using polyester, nylon, para or meta aramid yarns or any future fibers that may become available.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A woven webbing for use in a tiedown or sling for lifting, restraint or other material handling functions, the woven webbing comprising:

a central portion, the central portion having a top surface and an oppositely facing bottom surface, the top surface and bottom surface are woven in a first pattern for strength and abrasion resistance while remaining flexible;

tubular edges extending from either side of the central portion, the tubular edges having a woven second pattern, which is different from the first pattern, the tubular edges having interior cavities;

the interior cavities of the tubular edges containing floating core yarn, improving the cut and abrasion resistance of the tubular edges, the core yarn being processed to yield a high level of constructional elongation which is higher than yarn used in the central portion of the woven webbing.

2. The woven webbing as recited in claim 1, wherein the first pattern is a twill pattern.

3. The woven webbing as recited in claim 1, wherein the second pattern is a plain weave pattern.

4. The woven webbing as recited in claim 3, wherein some or all of the second pattern is woven from plied and twisted yarn.

5. The woven webbing as recited in claim 1, wherein transitions are provided between the central portion and the tubular edges, the transitions are woven in a third pattern which is different than the first pattern and the second pattern.

6. The woven webbing as recited in claim 1, wherein the core yarn in the interior cavities is twisted floating yarn.

7. The woven webbing as recited in claim 1, wherein the tubular edges includes a high modulus yarn material which changes the orientation of the yarn material away from the axial direction of tension when it is applied to the webbing, wherein the high modulus yarn material reduces the tension in the tubular edges while the webbing is in a loaded condition, thereby improving the durability and cut resistance of the tubular edges.

8. The woven webbing as recited in claim 7, wherein high modulus yarn material is a texturized or braided yarn.

9. The woven webbing as recited in claim 7, wherein the high modulus yarn material includes a first yarn that is heavily twisted or spirally wound around a second yarn, the second yarn having more flexibility or a lower modulus than the first yarn.

10. The woven webbing as recited in claim 7, wherein the high modulus yarn material includes a first yarn that is braided about a second yarn, the second yarn having more flexibility or a lower modulus than the first yarn.

11. The woven webbing as recited in claim 1, wherein the tubular edges have coated yarns.

12. A woven webbing for use in a tiedown or sling for lifting, restraint or other material handling functions, the woven webbing comprising:

a central portion, the central portion having a top surface and an oppositely facing bottom surface, the top surface and bottom surface being woven from first yarns for strength and abrasion resistance while remaining flexible, the top surface and bottom surface are woven in a first pattern for strength and abrasion resistance while remaining flexible, the first pattern being a twill pattern;

tubular edges extending from either side of the central portion, the tubular edges being woven from second yarns, which are different from the first yarns, the tubular edges are woven in a second pattern, the second pattern being a plain weave pattern which is woven from plied and twisted yarn;

the tubular edges have twisted yarn in interior cavities as floating yarn extending therethrough to enhance the cut resistance of the tubular edges;

transitions are provided between the central portion and the tubular edges, the transitions are woven in a third pattern which is different than the first pattern and the second pattern.

13. The woven webbing as recited in claim 12, wherein the tubular edges includes a high modulus yarn material which changes the orientation of the yarn material away from the axial direction of tension when it is applied to the webbing, wherein the high modulus yarn material reduces the tension in the tubular edges while the webbing is in a loaded condition, thereby improving the durability and cut resistance of the tubular edges.

14. A woven webbing for use in a tiedown or sling for lifting, restraint or other material handling functions, the woven webbing comprising:

a central portion, the central portion having a top surface and an oppositely facing bottom surface, the central portion having first yarn material being woven in for strength and abrasion resistance while remaining flexible;

tubular edges extending from either side of the central portion, the tubular edges being woven;

the tubular edges including a high modulus yarn material which changes the orientation of the yarn material away from the axial direction of tension when a load is applied to the webbing, wherein the high modulus yarn material reduces the tension in the tubular edges while the webbing is in a loaded condition, thereby improving the durability and cut resistance of the tubular edges;

the high modulus yarn material includes a first yarn that is spirally wound around a second yarn, the second yarn having more flexibility or a lower modulus than the first yarn.

15. The woven webbing as recited in claim 14, wherein the high modulus yarn material is a texturized or braided yarn.

* * * * *